US012808188B2

(12) United States Patent
Lewis et al.

(10) Patent No.: US 12,808,188 B2
(45) Date of Patent: Nov. 24, 2026

(54) COVER SYSTEM FOR STORAGE TANKS

(71) Applicant: Roundtable Engineering Solutions, LLC, Colorado Springs, CO (US)

(72) Inventors: Brian Lewis, Colorado Springs, CO (US); Krystal Holifield, Pinehurst, TX (US); Chris Blinn, Florissant, CO (US); Perry Bang, Colorado Springs, CO (US)

(73) Assignee: Roundtable Engineering Solutions, LLC, Colorado Springs, CO (US)

( * ) Notice: Subject to any disclaimer, the term of this patent is extended or adjusted under 35 U.S.C. 154(b) by 232 days.

(21) Appl. No.: 18/521,902

(22) Filed: Nov. 28, 2023

(65) Prior Publication Data

US 2025/0172000 A1 May 29, 2025

(51) Int. Cl.
*E04B 7/08* (2006.01)

(52) U.S. Cl.
CPC ..... *E04B 7/08* (2013.01)

(58) Field of Classification Search
CPC ... E04B 7/04; E04B 7/08; E04B 7/105; E04B 1/3211; E04B 2001/327; E04B 2001/3247; E04B 2001/3252; E04B 2001/3276; E04B 2001/3288; E04B 2001/3294; E04D 3/366
See application file for complete search history.

(56) References Cited

U.S. PATENT DOCUMENTS

| | | | | |
|---|---|---|---|---|
| 2,433,728 | A * | 12/1947 | Attwell | E04B 7/08 52/417 |
| 2,574,937 | A * | 11/1951 | Sampson | E04D 3/366 52/277 |
| 3,909,994 | A | 10/1975 | Richter | |
| 5,315,801 | A | 5/1994 | Anderson et al. | |
| 6,460,309 | B1 * | 10/2002 | Schneider | E04B 7/063 52/843 |
| 7,743,582 | B1 * | 6/2010 | Petricio Yaksic | E04B 7/028 52/745.06 |
| 8,984,843 | B2 * | 3/2015 | Tak | E04H 7/065 52/837 |
| 2008/0236057 | A1 * | 10/2008 | McCarty | E04B 7/08 52/80.1 |
| 2015/0233107 | A1 * | 8/2015 | Harnois | E04B 1/34384 52/63 |

FOREIGN PATENT DOCUMENTS

| | | | | |
|---|---|---|---|---|
| GB | 723894 | A * | 2/1955 | E04H 7/065 |
| GB | 2453865 | A * | 4/2009 | E04H 1/12 |
| JP | H11324249 | A * | 11/1999 | |

* cited by examiner

*Primary Examiner* — Christine T Cajilig
(74) *Attorney, Agent, or Firm* — Banner & Witcoff, Ltd.

(57) ABSTRACT

Aspects of the disclosure relate to a cover assembly for storage tanks. A cover may comprise a plurality of radial subsections/panels that may be joined using structural members and battens. For example, edges of adjacent radial subsections may be bent/curved into a slot of a structural member and affixed using a batten that may slid into the slot. Fasteners, that may be affixed from an inner surface of the cover, may be used to secure the batten against the structural member. A low profile of the batten combined with fasteners that do not protrude out of a top surface of the cover may prevent pooling of water on the surface of the cover and leakage of water into the tank.

20 Claims, 12 Drawing Sheets

SECTION B-B

120

200C

SECTION A–A

SECTION B--B

COVER SYSTEM FOR STORAGE TANKS

TECHNICAL FIELD

Aspects of the disclosure generally relate to storage tank structures. More specifically, aspects of this disclosure relate to the design and construction of cover systems for storage tanks.

BACKGROUND

Storage tanks may be used for wide variety of applications. For examples, storage tanks may be used or storing liquids such as water, waste water, oil, chemicals, etc. A common construction for liquid storage tanks may comprise a cylindrical tank shell covered by a fixed or floating roof. For example, a fixed roof may be a cone-shaped or dome-shaped roof that is permanently affixed to the cylindrical tank shell. An example of a fixed dome-shaped roof is a geodesic dome that comprises a plurality of interlocking triangle-shaped panels. In contrast, floating roof tanks comprise an open-topped cylindrical tank shell with a roof that rises or falls with a liquid level in the tank.

SUMMARY

The following summary presents a simplified summary of certain features. The summary is not an extensive overview and is not intended to identify key or critical elements.

A storage tank may comprise a tank shell that may be covered with a dome. The tank shell may comprise a cylindrical shape. The dome may comprise a plurality of curved, radial subsections that may be affixed to a common compression ring and an upper edge of the tank shell. A plurality of curved, radial structural members may be used to join adjacent subsections. For example, radial edges of adjacent subsections of the dome may be curved inwards and fitted into a slot of a corresponding structural member. A plurality of curved, radial battens may be used for securing the subsections of the dome. For example, a corresponding batten may be fit into a corresponding slot such that the radial edges of the adjacent subsections are sandwiched/wedged between the corresponding batten and the corresponding structural member. A plurality of fasteners may be used to complete the attachment of the subsections, the structural members, and the battens. The plurality of fasteners may be affixed from concave surfaces of the structural members to secure the battens against the structural members. Each of the plurality of fasteners may be sized to be contained within the battens, such that the fasteners do not protrude out a top surface of the dome.

These and other features and advantages are described in greater detail below.

BRIEF DESCRIPTION OF THE DRAWINGS

The present disclosure is illustrated by way of example and not limited in the accompanying figures in which like reference numerals indicate similar elements and in which.

DETAILED DESCRIPTION

Figure 1A:
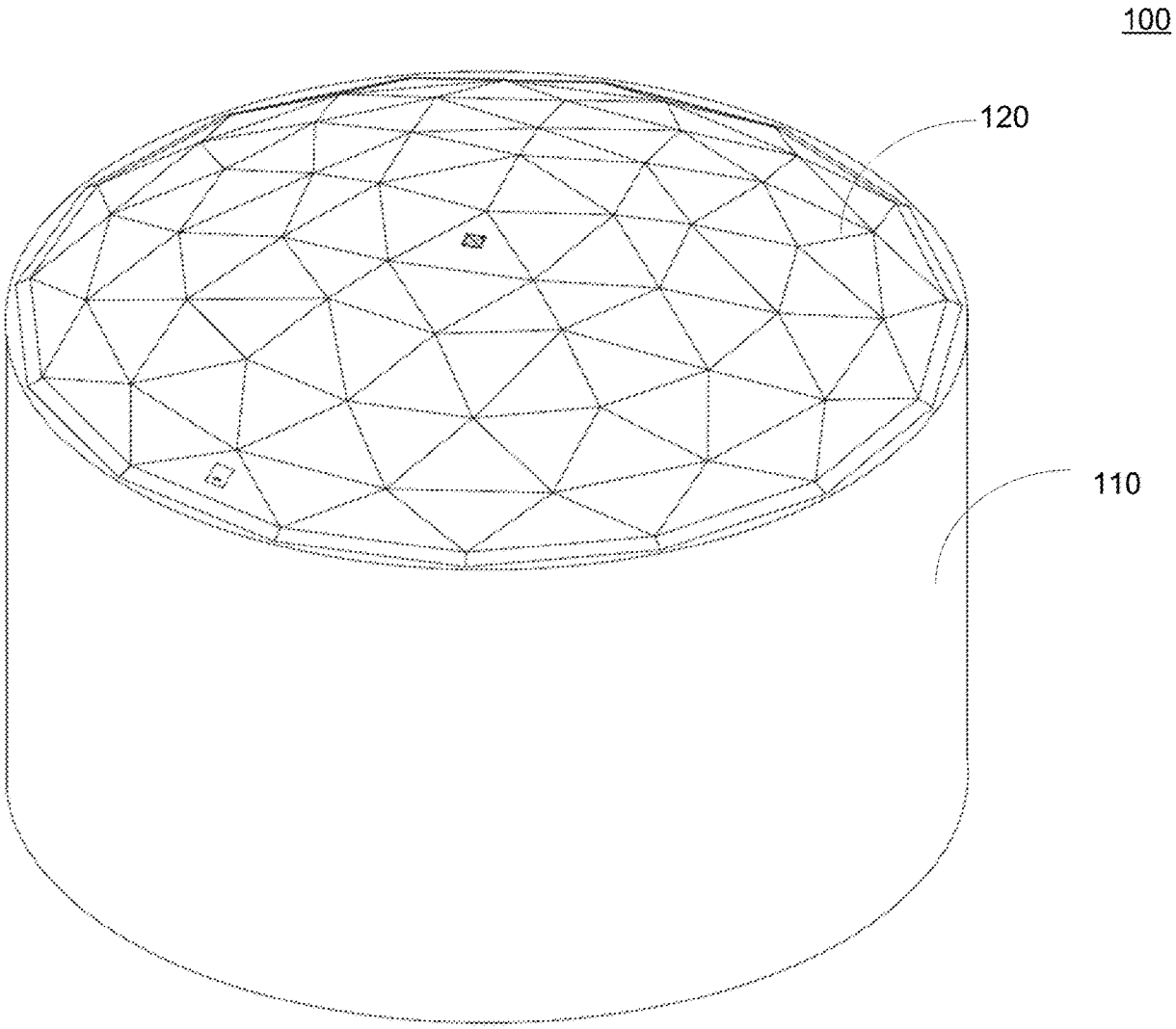
FIG. 1A shows a storage tank with a geodesic dome-shaped cover.

In the following description of various illustrative embodiments, reference is made to the accompanying drawings, which form a part hereof, and in which is shown, by way of illustration, various embodiments in which aspects of the disclosure may be practiced. It is to be understood that other embodiments may be utilized, and structural and functional modifications may be made, without departing from the scope of the present disclosure.

As described above, storage tanks with domes (e.g., geodesic domes) may be commonly used for storage of liquids. Aluminum geodesic domes have been used commercially in oil/gas industries and water/wastewater storage for decades. For example, aluminum geodesic domes are used in storage tanks (e.g., cylindrical storage tanks) for weather shielding, gas containment, odor/vapor control, and/or for other purposes. Geodesic domes range in size from around 20 feet in diameter to 400 feet (or larger) in diameter. Most domes used in water/wastewater industry are between 30 feet in diameter and 120 feet in diameter, while domes used in the oil/gas industry are between 50 feet in diameter and 200 feet in diameter.

Geodesic domes may have several drawbacks. Geodesic domes are complicated to fabricate and construct. For example, a typical geodesic dome may have dozens of unique parts and hundreds of total number of parts, resulting in high cost and complexity. Further, the interfaces between the different parts (e.g., panels, battens, etc.) may be prone to leaking. Battens may impede a flow of water off the surface of dome. As a result, water (e.g., rainwater) may collect at hub covers that are overlaid over joints between different battens. Prolonged pooling of water at the hub covers may cause water to seep inside the dome via leak paths that may exist between hub covers, battens, and/or other exposed fasteners on the dome surface. While caulk may be used to fix any leaks, caulk may degrade over time (e.g., due to exposure to sun, thermal expansion/contraction, etc.) and crack and/or peel, thereby providing only a temporary fix for leaks at best. Another approach to prevent leaks is to use welding to attach the various panels of the dome and/or to use steel roofs. However, such approaches are typically time-intensive and/or expensive.

Various examples herein describe design, assembly, and construction of an improved dome-shaped cover system for cylindrical storage tanks. Example dome structures as described herein may not comprise any exposed fasteners, gaskets, and/or other components that may be prone to leaking. A dome may comprise a plurality of curved radial subsections/panels that are each affixed at a common compression ring using a first set of support pins. The compression ring may be located at the center of the dome. Each of the radial subsections/panels may also be affixed to an upper surface or edge, associated with a cylindrical tank shell, using a second set of support pins.

An adjacent pair of panels (e.g., corresponding to the radial subsections) may be affixed using a curved batten and a curved structural member. The battens and the structural members may extend radially outwards from the center of the dome, and may be located between adjacent pairs of panels. For examples, the battens and the structural members may be arranged in a spoke pattern from the center of the dome. Edges of the panels (e.g., rolled edges) may be sandwiched/wedged between the batten and the structural member. Fasteners (e.g., bolts or screws) may be driven, from the concave surface of the dome/structural member, to attach the batten to the panel. The components of the dome (e.g., radial subsections/panels, battens, structural members, etc.) may be manufactured using aluminum. In other examples, one or more other materials (e.g., metals, ceramics, polymers, etc.) may be used (e.g., instead of or in conjunction with aluminum). Gaskets (e.g., rubber, silicone, or polymer gaskets) may be used to form a seal between the battens and the structural members.

The dome-shaped cover system for storage tanks, as described herein, may provide numerous advantages over conventional covers and roofs. Using radial subsections/panels to assemble the dome may reduce pooling of liquid (e.g., rain water, snowmelt water, etc.) on a top surface of the dome, thereby reducing the probability of a leakage into the tank. The low-profile joint assembly used for attaching adjacent subsections/panels of the dome and/or non-usage of hub covers (e.g., as required for geodesic domes) may facilitate easy drainage of any water than may fall on the top surface of the dome. The dome may not have any exposed fasteners on the top surface of the dome further reducing probability of water leakage. The components of the dome (e.g., radial subsections/panels, battens, structural members, etc.) may be manufactured using aluminum, thereby reducing weight. Further, in comparison to geodesic domes, the domes described herein may require fewer number of unique parts and fewer total number of parts, thereby reducing component manufacturing and dome assembly costs.

FIG. 1A shows a storage tank with a geodesic dome-shaped cover. The storage tank 100 of FIG. 1 may comprise a cylindrical tank shell 110. The storage tank 100 may further comprise a geodesic dome 120 that is affixed to an upper edge of the tank shell 110 and that covers the cylindrical tank shell 110.

Figure 1B:
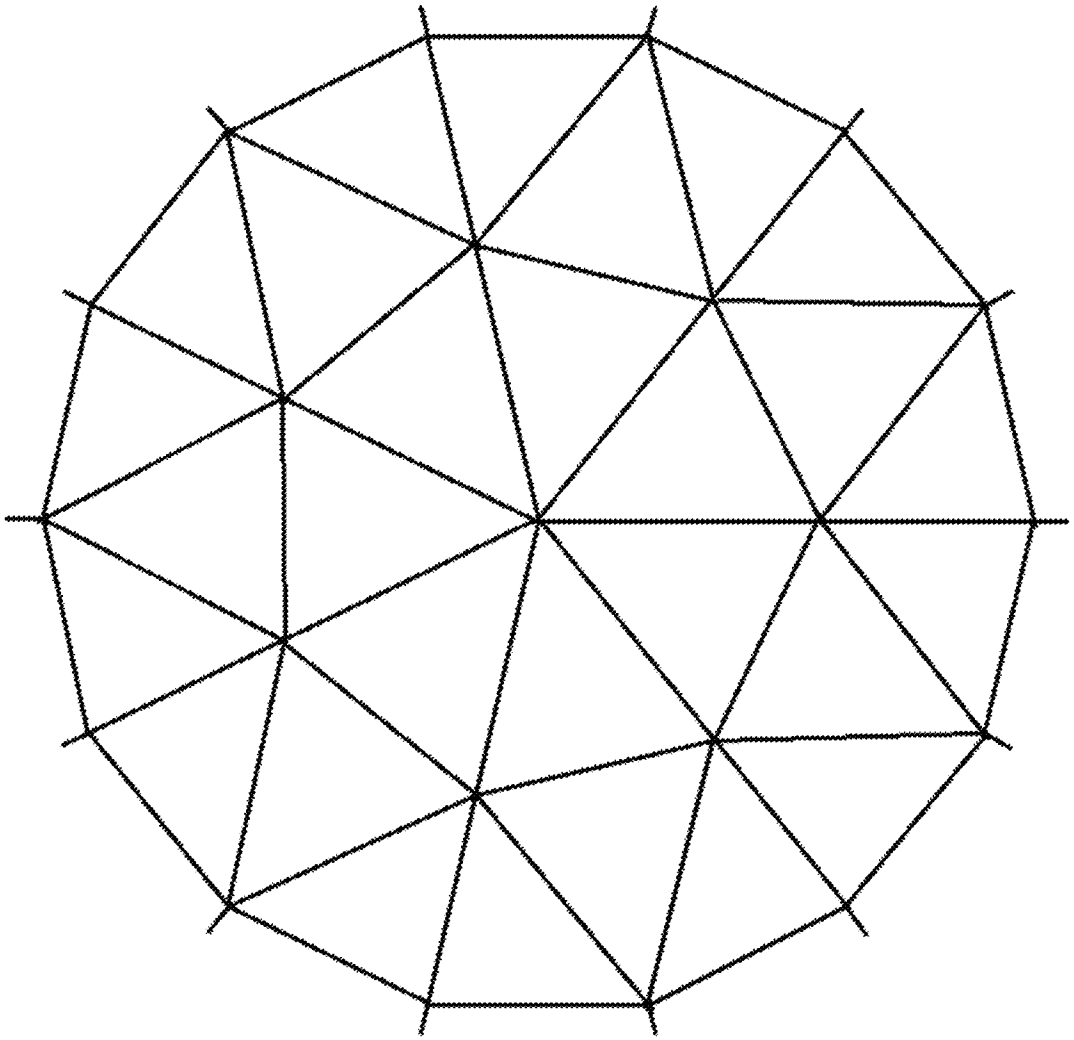
FIG. 1B shows a two-dimensional top view of a geodesic dome-shaped cover.

FIG. 1B shows a two-dimensional top view of a geodesic dome-shaped cover. The geodesic dome-shaped cover may comprise the dome 120 described with respect to FIG. 1A. The dome 120 may be coupled to a storage tank, such as shown in FIG. 1A with respect to storage tank 100. The geodesic dome-shaped cover may comprise a pattern of triangular-shaped portions. Each corner of each triangular-shaped portion may be coupled to one or more corners of adjacent triangle-shaped portions to form a joint. Each joint having a height lower than one or more other joints of a triangular-shaped portion within the geodesic dome-shaped cover may experience pooling of water at or around the joint, for example, due to rainwater and/or snowmelt water collecting at a lowest portion of the triangular-shaped portion. As a result, leaks may occur throughout the dome 120, for example, potentially at one or more joints within each triangular-shaped portion.

Figure 2A:
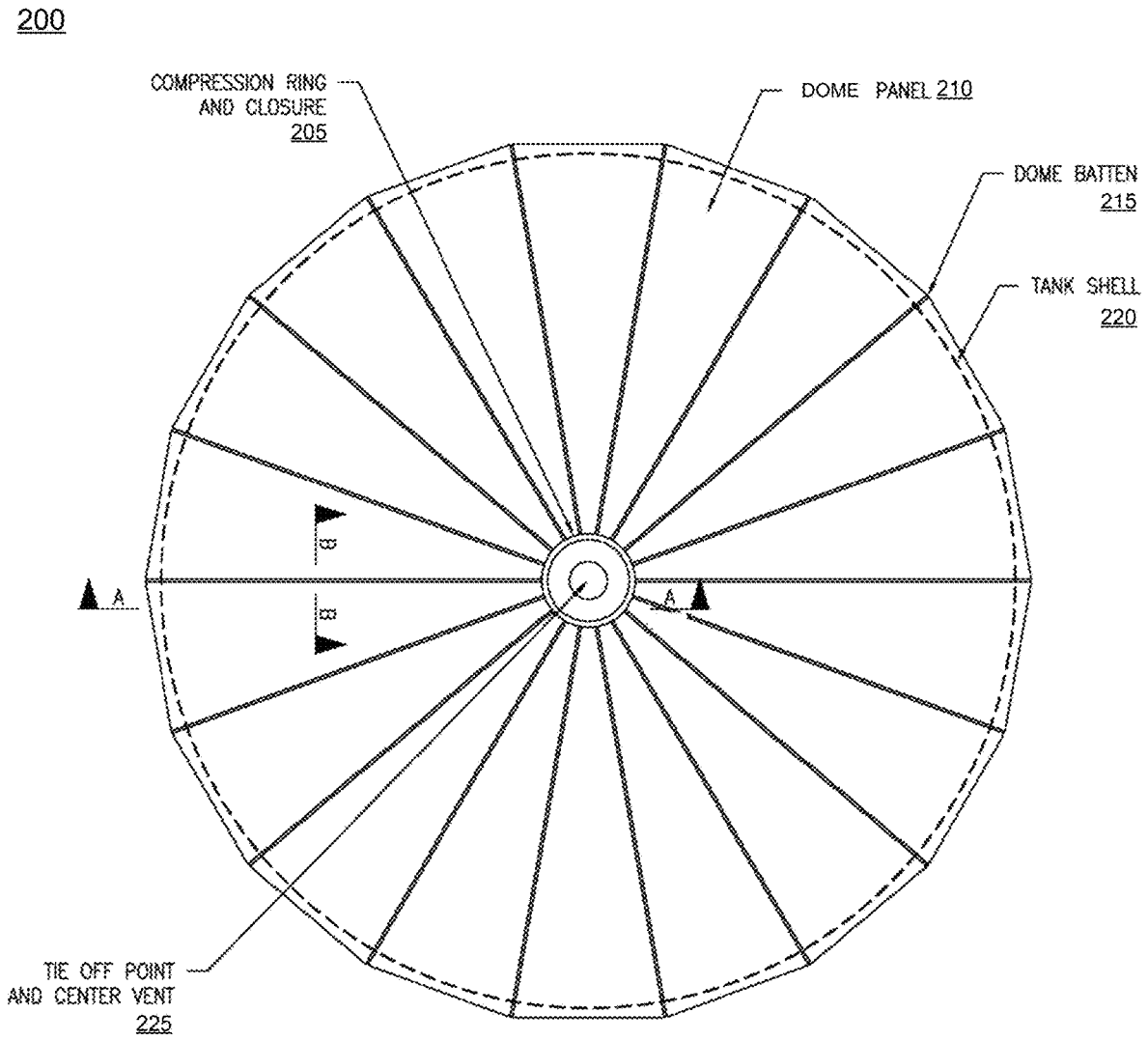
FIG. 2A shows a two-dimensional top view of an example dome for covering storage tanks.

FIG. 2A shows a two-dimensional top view 200 of an example dome for covering storage tanks. For example, a storage tank may comprise a tank shell 220. The tank shell 220 may comprise a cylindrical shape of any height and with any diameter. As shown in FIG. 2A, the tank shell 220 is shown as a circular shape, representing the cylindrical tank shell 220 from a top view. A dome, as shown in FIG. 2A, may be used for covering the tank shell 220. The example dome may comprise a plurality of curved, radial dome panels 210 (e.g., subsections, or formed panels). The dome panels 210 may be affixed to and/or extend from a common compression ring 205 to an upper edge of the tank shell 220. For example, respective first edges (e.g., inner edges) of the dome panels 210 may be welded (or epoxied, bolted, clamped, sealed, or otherwise attached) to the compression ring 205, and respective second edges (e.g., outer edges) of the dome panels may be welded (or epoxied, epoxied, bolted, clamped, sealed, or otherwise attached) to the upper edge of the tank shell 220.

As further described herein, adjacent dome panels 210 of the dome may be affixed using dome battens 215 (e.g., curved, radial battens) and structural members (not shown). A tie off point (e.g., anchor point, painter's hitch, fall arrest, etc.) and center vent 225 may be attached to the compression ring 205. The dome may comprise a skylight attached to the compression ring 205 (e.g., instead of or in addition to the center vent 225). Section view A-A of the dome is detailed in FIGS. 3A-3C. Section view B-B of the dome is detailed in FIGS. 4 and 5.

Figure 2B:
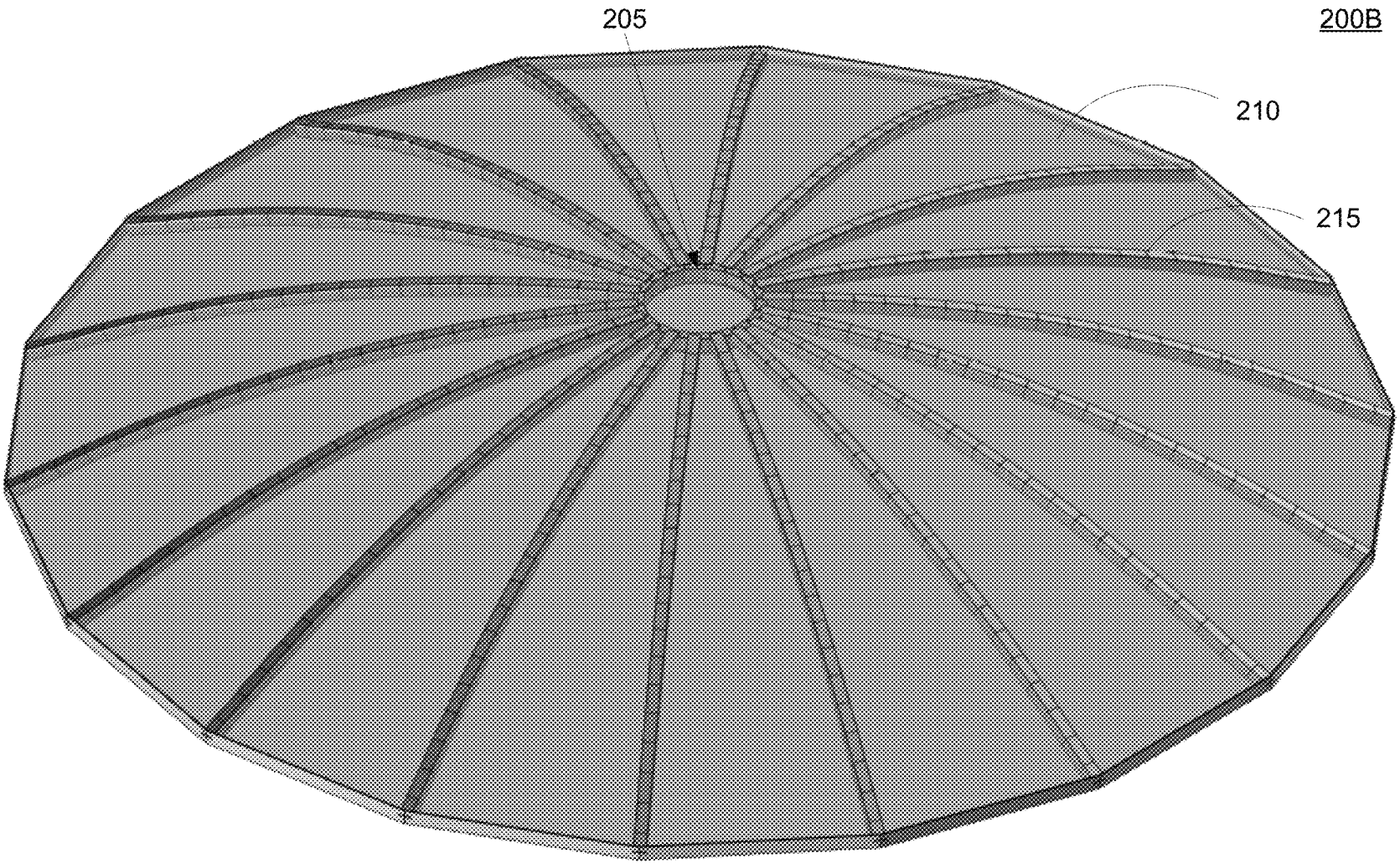
FIG. 2B shows a three-dimensional top view of an example dome for covering storage tanks.

FIG. 2B shows a three-dimensional top view 200B of an example dome for covering storage tanks. The example dome may comprise the dome described with respect to FIG. 2A. The dome may comprise a compression ring 205 at the center coupled to dome battens 215 (e.g., curved, radial battens) extending radially from the compression ring 205 to the edge of the dome. Dome panels 210 may be fixed in between each dome batten 215 to form a covering for a storage tank. Adjacent dome panels 210 of the dome may be affixed using dome battens 215 and structural members (not shown). Structural members are further described herein with respect to FIGS. 3A-3C, 4 and 5.

Figure 2C:
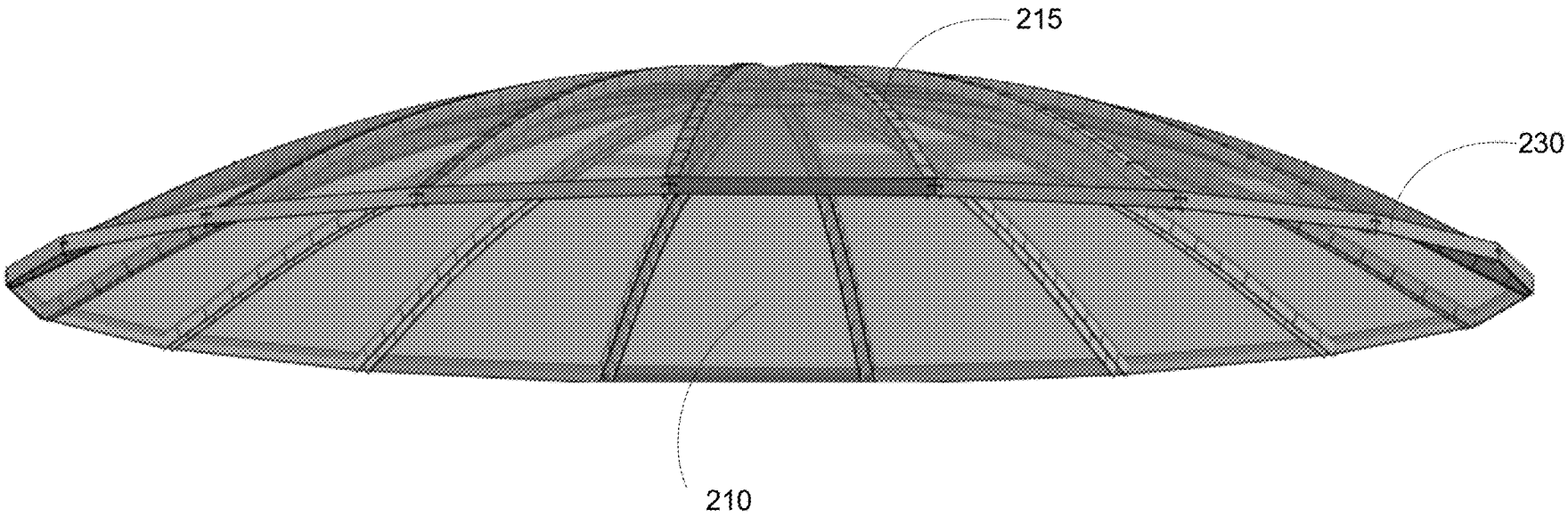
FIG. 2C shows a three-dimensional side view of an example dome for covering storage tanks.

FIG. 2C shows a three-dimensional side view 200C of an example dome for covering storage tanks. The example dome may comprise the dome described with respect to FIG. 2A and/or FIG. 2B. The dome may comprise dome battens 215 (e.g., curved, radial battens) extending radially from the top of the dome to the edge of the dome 230. Dome panels 210 may be fixed in between each dome batten 215 to form a covering for a storage tank. The edge of the dome 230 may comprise one or portions. For example, each portion of the edge of the dome 230 may be attached to a dome batten 215 at each end. Adjacent dome panels 210 of the dome may be affixed using dome battens 215 and structural members (not shown).

Figure 2D:
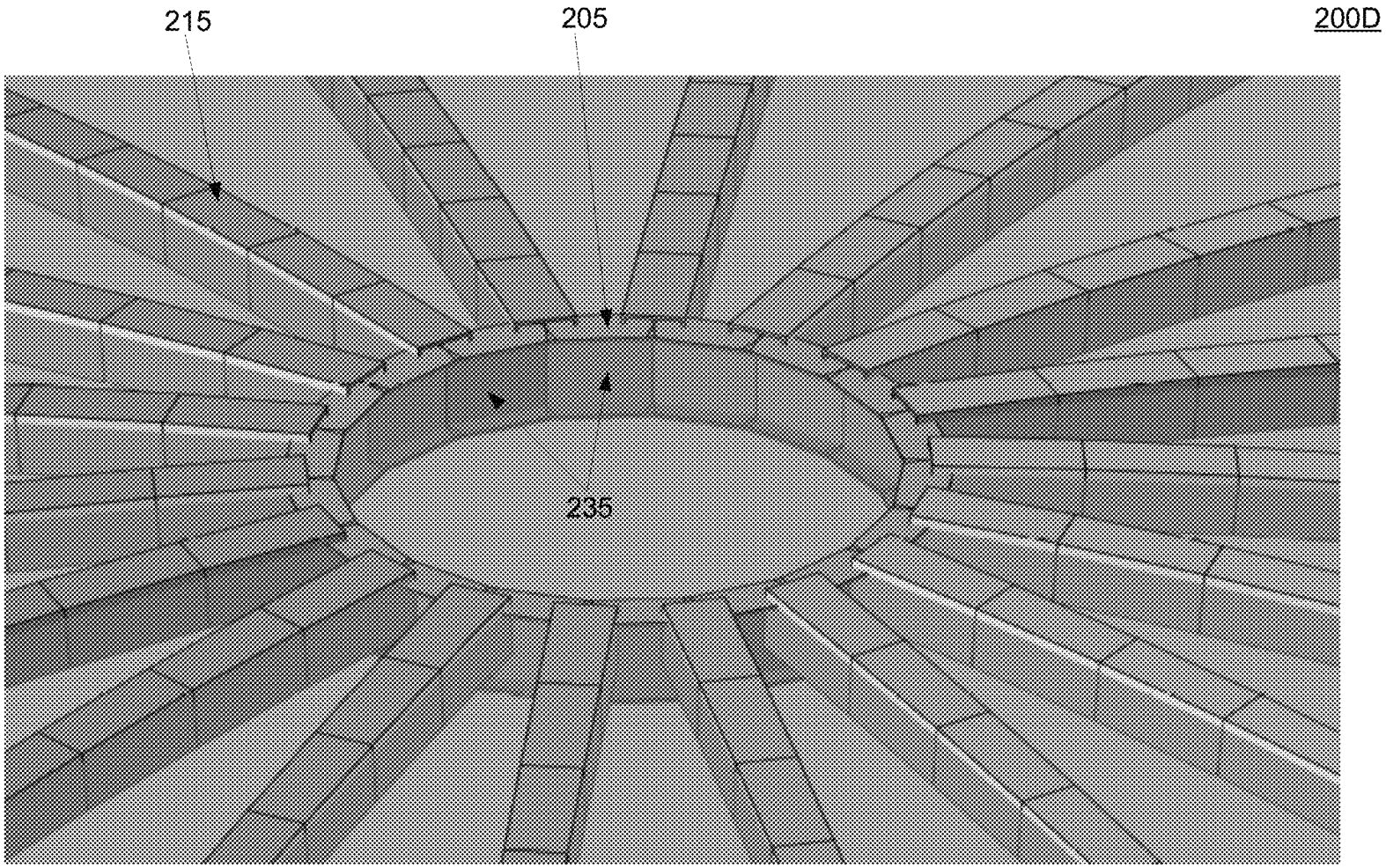
FIG. 2D shows a three-dimensional top view of a center portion of an example dome for covering storage tanks.

FIG. 2D shows a three-dimensional top view 200D of a center portion of an example dome for covering storage tanks. The example dome may comprise the dome described with respect to FIG. 2A, FIG. 2B, and/or FIG. 2C. The example dome may comprise a compression ring 205 at the top. The compression ring 205 may comprise a plurality of attachment portions 235. One or more of the attachment portions 235 may secure the compression ring 205 to an edge of a dome batten 215 and/or to an edge of an adjacent attachment portion, such as shown in FIG. 2D.

Figure 3A:
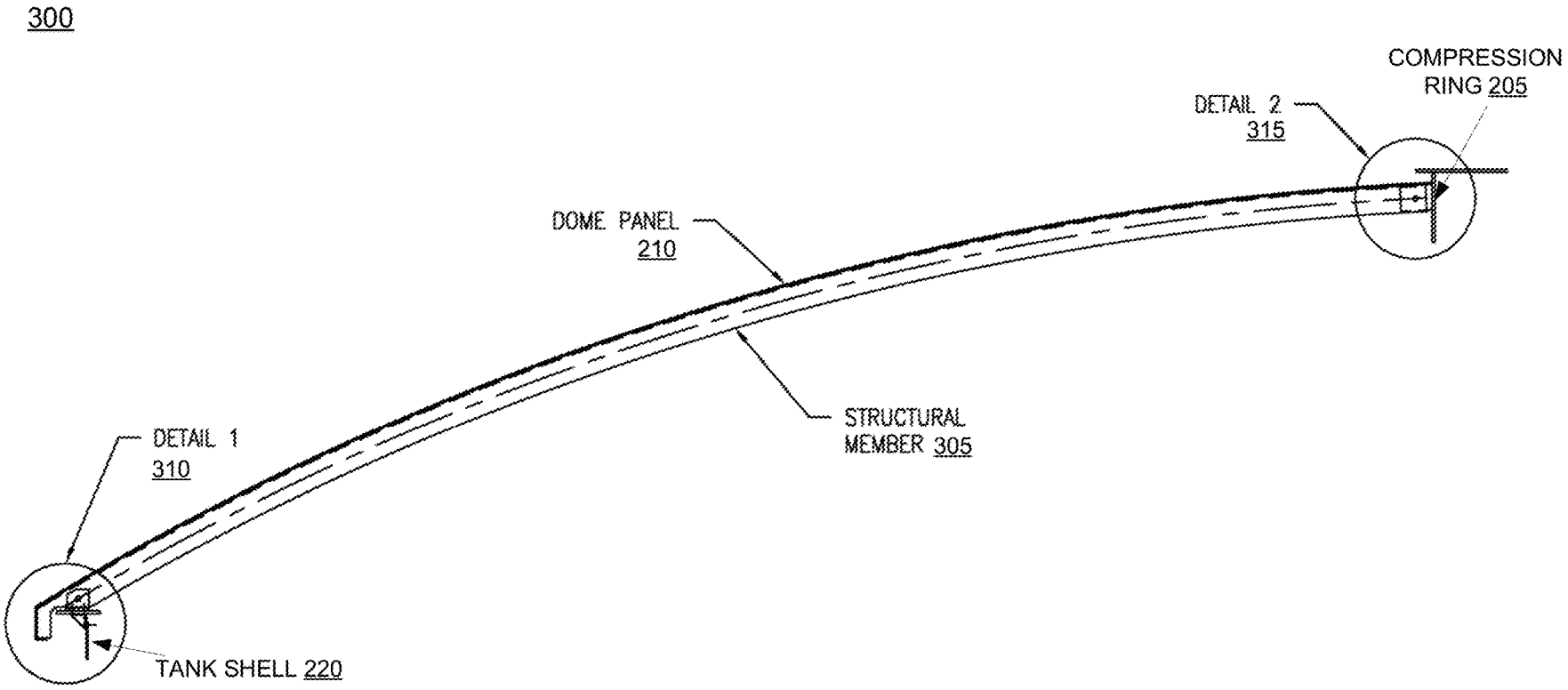
FIG. 3A shows an example cross-section of half of a dome.

FIG. 3A shows an example cross-section of half of a dome. The example cross-section 300 of FIG. 3A may correspond to the section view A-A of FIG. 2A. The cross-section 300 shows, in addition to the dome panel 210, a curved, radial structural member 305. As further described with respect to FIGS. 4 and 5, a plurality of structural members 305 and dome battens (e.g., dome battens 215) may be used to secure the dome panels 210 to form the dome. Detailed views of sections of FIG. 3A (detail 1 310 and detail 2 315) may correspond to attachments of the dome to other components of the storage tank. For example, detail 1 310 shows a first attachment of the dome to the tank shell 220, and detail 2 315 shows a second attachment of the dome to the compression ring 205.

Figure 3B:
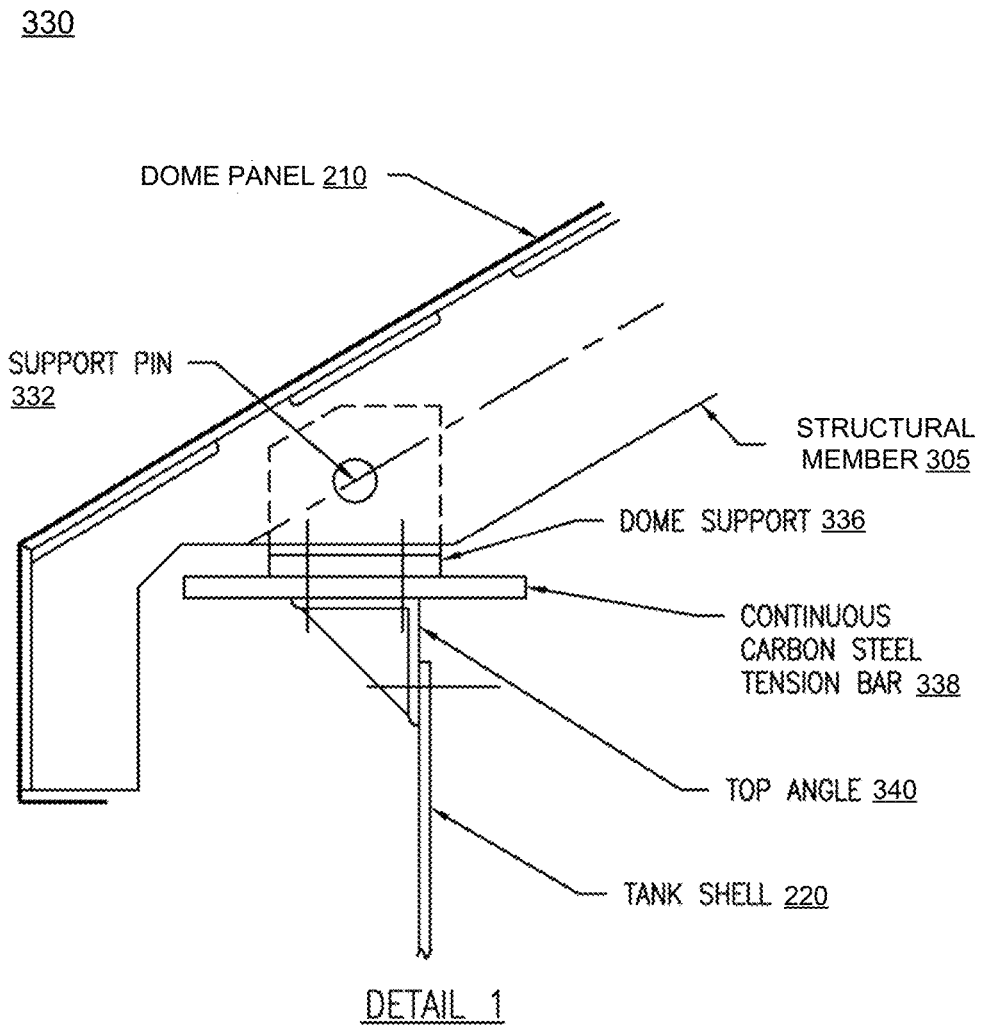
FIG. 3B shows a detailed view of a cross-section of a dome portion near an edge of a storage tank.

FIG. 3B shows a detailed view of a cross-section of a dome portion near an edge of a storage tank. The detailed view 330 of FIG. 3B may correspond to detail 1 310 as shown in FIG. 3A. The structural member 305 may be attached to the tank shell 220 via one or more components. For example, the structural member 305 may be attached to the tank shell 220 via a dome support 336 using a support pin 332. The dome support 336 may rest on a continuous tension bar 338 (e.g., carbon steel tension bar). The tension bar 338 may be circular with a radius that is approximately equal to that of the tank shell 220. The tension bar 338 may be attached to the tank shell 220 using a top angle 340.

Figure 3C:
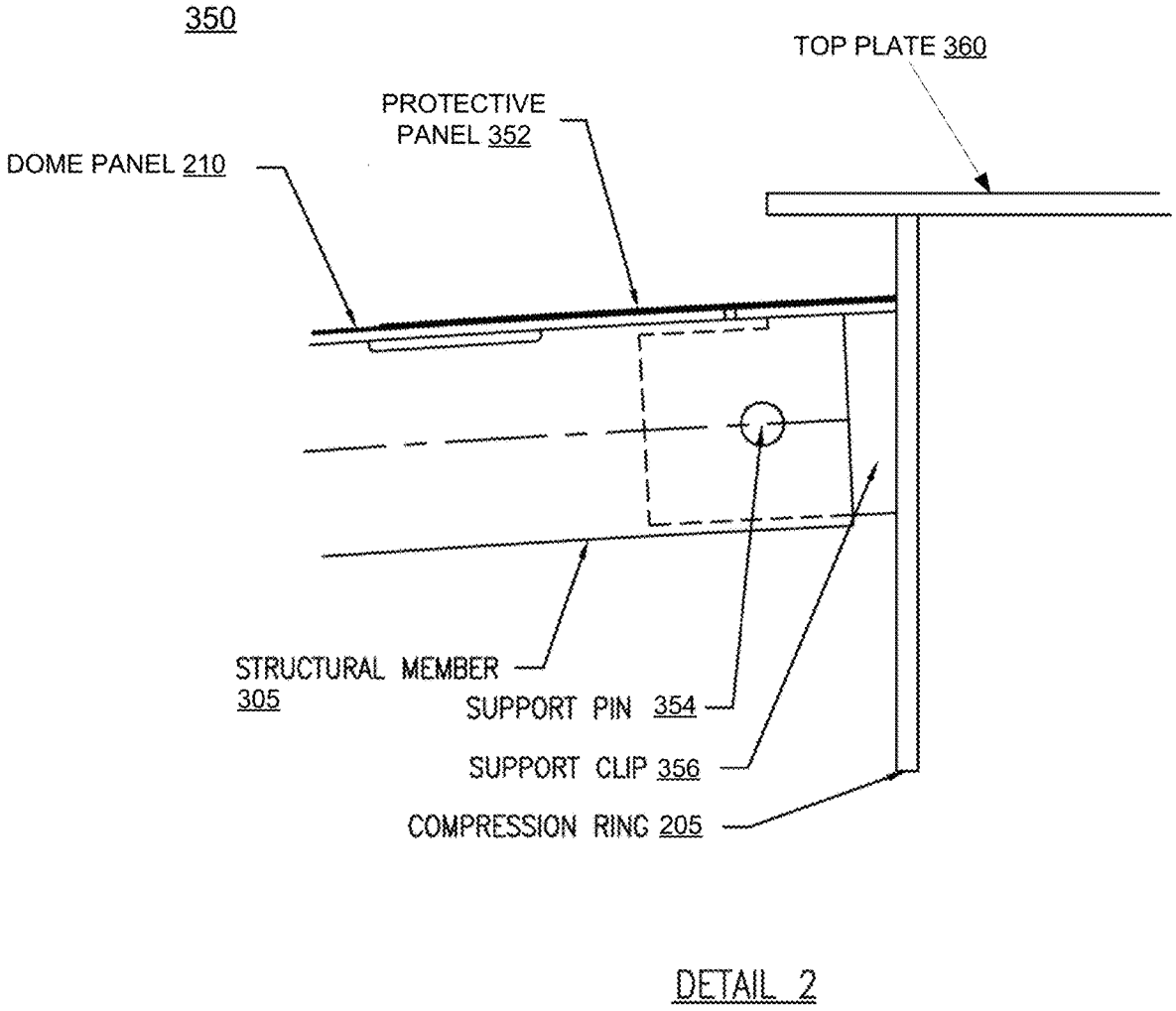
FIG. 3C shows a detailed view of a cross-section of a dome portion near a center of a dome.

FIG. 3C shows a detailed view of a cross-section of a dome portion near a center of a dome. The detailed view 350 of FIG. 3C may correspond to detail 2 315 as shown in FIG. 3B. The structural member 305 may be attached to the compression ring 205 via one or more components. For example, the structural member 305 may be attached to the compression ring 205 via a support clip 356 using a support pin 354. A top plate 360 may be used to cover the compression ring 205. In an example, the top plate 360 may be vented and/or may comprise a skylight.

The various examples described with respect to FIGS. 2A-2D and 3A-3C describe a dome (e.g., for a tank shell) comprising curved dome panels/subsections, curved battens, and curved structural members. In some examples, at least some panels/subsections, battens, and/or structural members of a cover (e.g., for a tank shell) may be flat and/or straight. In some examples, a cover/top for a tank shell may be flat. For example, a cover/top for a tank shell may be circular, flat, and/or may comprise flat, radial panels; straight, radial battens; and/or straight, radial structural members.

Figure 4:
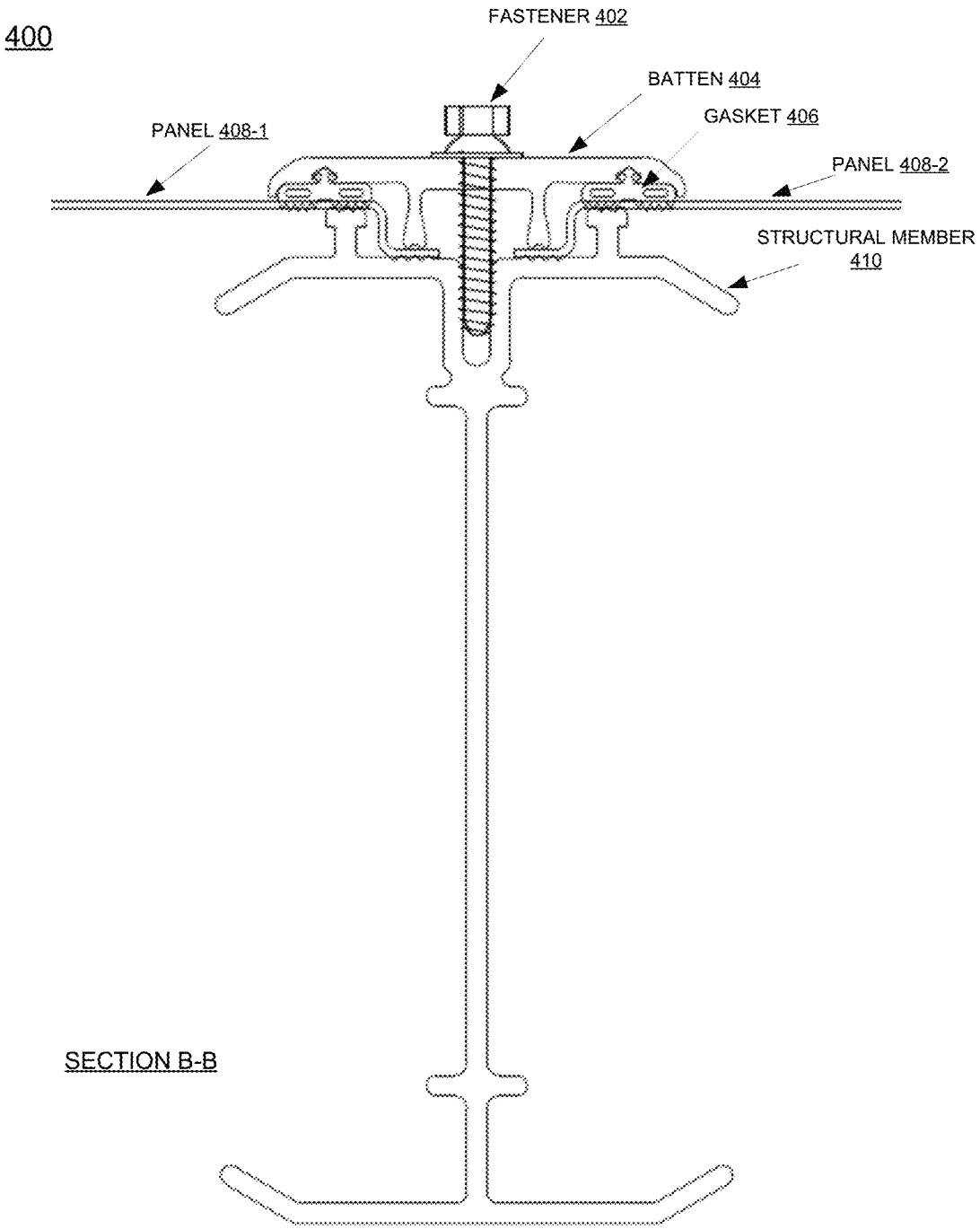
FIG. 4 shows a cross-section of a joint assembly with an exposed fastener.

FIG. 4 shows a cross-section of a joint assembly with an exposed fastener. A cross-section 400 of the joint assembly (e.g., a bracket assembly) as shown in FIG. 4 may correspond to the section view B-B of FIG. 2A. The joint assembly may be used to attach two panels (e.g., adjacent radial subsections) of a dome using a batten, a structural member, gaskets, and a fastener. For example, the joint assembly may be used to attach two adjacent dome panels 210 as shown in FIG. 2A.

The joint assembly of FIG. 4 may be used to attach two panels 408 (e.g., panel 408-1 and panel 408-2). The panels 408 may correspond to curved, radial subsections/dome panels of a dome (e.g., covering a storage tank). The panels 408 may be affixed adjacent to each other by sandwiching/wedging the panels 408 between a batten 404 (e.g., a curved batten) and the structural member 410 (e.g., a curved structural member). Gaskets 406 (e.g., made of silicone, rubber, or any polymer) may be used at interfaces between the batten 404 and the panels 408 to form a water tight seal. A fastener 402 (e.g., a screw or a bolt) may be driven into the structural member 410 from a top of the batten 404 to press the batten 404 against the panels 408, and the panels 408 against the structural member 410, thereby forming the joint between the panels 408-1 and 408-2. A series of fasteners may be placed at regular intervals along an interface between the panels 408-1 and 408-2 to attach panel 408-1 and 408-2. For example, the fasteners may be placed with a spacing of 9 inches to 12 inches (or any other spacing) between adjacent fasteners.

The fastener 402 may be driven into the structural member 410 from a top of the dome (e.g., convex surface of the dome and/or convex side of the batten 404). Accordingly, the joint assembly of FIG. 4 may comprise exposed fasteners on a top surface of the dome (e.g., a top surface of the batten 404).

In some examples, the joint assembly (e.g., a bracket assembly) such as shown in FIG. 4 may be used for a flat cover for a tank shell. For example, the panels 408 may correspond to flat, radial subsections/panels of a circular, flat cover (e.g., covering a storage tank), the batten 404 may be a straight batten, and the structural member 410 may be a straight structural member. For flat covers, the fastener 402 may be driven into the structural member 410 from an outer surface of the cover (e.g., a top surface of the batten 404).

Figure 5:
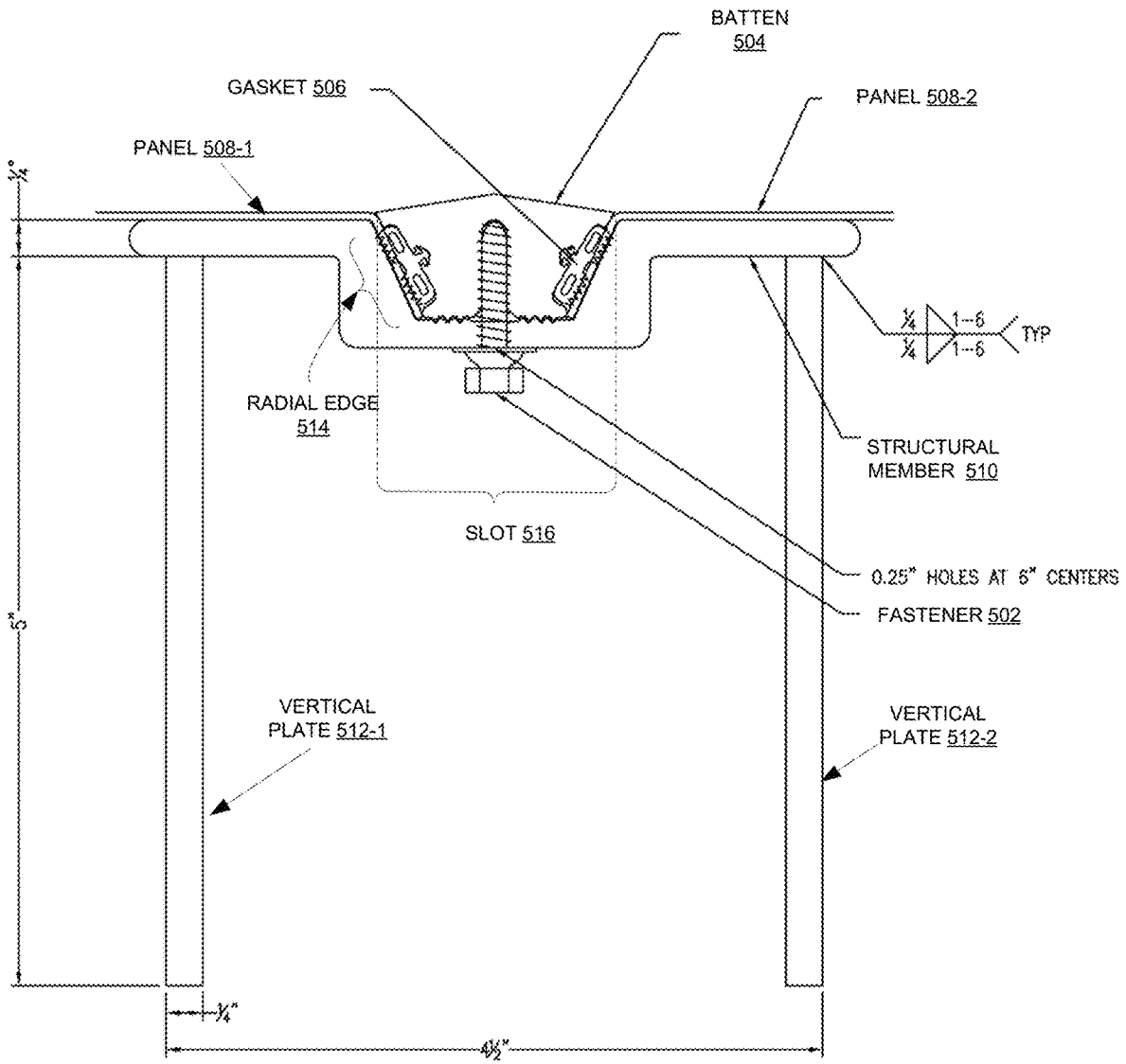
FIG. 5 shows a cross-section of a joint assembly with an unexposed fastener.

FIG. 5 shows a cross-section of a joint assembly with an unexposed fastener. A cross-section 500 of the joint assembly (e.g., a bracket assembly) as shown in FIG. 5 may correspond to the section view B-B of FIG. 2A. The joint assembly may be used to attach two panels (e.g., adjacent radial subsections) of a dome using a batten, a structural member, gaskets, and a fastener. For example, the joint assembly may be used to attach two adjacent dome panels 210 as shown in FIG. 2A.

The joint assembly of FIG. 5 may be used to attach two panels 508 (e.g., panel 508-1 and panel 508-2). The panels 508 may correspond to curved, radial subsections/dome panels of a dome (e.g., covering a storage tank). The panels 508 may be affixed adjacent to each other by sandwiching/wedging the panels 508 between a batten 504 and the structural member 510. For example, the panels 508 may be wedged between a horizontal plate of the structural member 510 and the batten 504.

The horizontal plate of the structural member 510 may comprise a slot 516 (e.g., a radial slot/groove). A radial edge 514 of a panel 508 may be bent/curved inwards before being affixed, in the slot 516, to the structural member 510 (e.g., the horizontal plate of the structural member 510) using the batten 504. For example, the radial edge 514 may be formed and/or rolled along a spline. The radial edge 514 may be formed and/or rolled prior to installation and/or coupling with the structural member 510.

A fastener 502 (e.g., a screw or a bolt) may be driven through the structural member 510 into the batten 504. The fastener 502 may press both the panels 508-1 and 508-2 against the structural member 510 and the batten 504, thereby forming the joint between the panels 508-1 and 508-2. A series of fasteners (e.g., including the fastener 502) may be placed at regular intervals along the structural member 510 (e.g., the horizontal plate of the structural member 510) to attach panel 408-1 and 408-2. For example, the fasteners may be placed with a spacing of 6" (or any other spacing) between adjacent fasteners. Gaskets 506 (e.g., made of silicone, rubber, or any polymer) may be used at interfaces between the batten 504 and the panels 508 to form a water tight seal.

The fastener 502 may be driven/inserted into the structural member 510 from underneath the dome (e.g., concave/inner surface of the dome and/or concave surface/side of the structural member). Further, the fastener 502 may be sized to be contained within the batten 504 (e.g., may not extend out of a top/exposed surface of the batten 504). Accordingly, a screw chase in the batten 504 for the fastener 502 may only extend partially into the batten 504. The fastener 502 not extending out of the batten 504 may ensure that there are no protrusions on a top surface of the dome and may reduce potential leakage of any water into the dome.

The batten 504 may be manufactured using extrusion (e.g., or any other manufacturing method). The horizontal plate of the structural member 510 may be manufactured using extrusion (e.g., or any other manufacturing method). The horizontal plate may be welded, epoxied, or otherwise affixed to the vertical plates 512 to create the structural member 510.

The dimensions shown in FIG. 5 are merely exemplary, and the joint assembly of FIG. 5 may have component parts with other dimensions. For example, the holes for fasteners (e.g., including the fastener 502) may have a different dimension and/or may be spaced at a different distance from each other. The vertical plates 512 may have a different thickness and/or may be separated by a different distance from one another.

In some examples, the joint assembly (e.g., a bracket assembly) such as shown in FIG. 5 may be used for a flat cover for a tank shell. For example, the panels 508 may correspond to flat, radial subsections/panels of a circular, cover (e.g., covering a storage tank), the batten 504 may be a straight batten, and/or the structural member 510 may be a straight structural member. For flat covers, the fastener 502 may be driven into the structural member 510 from an inner surface of the flat cover (e.g., inner surface of the structural member 510, or a surface of the structural member 510 that faces the inside of the tank).

The fastener 502 being affixed from the concave surface of the dome may advantageously enable inclusion of additional protective layer(s) on top of the dome. For example, since no protrusions of fasteners are present on the top surface of the dome, an additional protective panel may be attached to the top surface. As shown in FIG. 3B, for example, a protective panel 352 may be welded, epoxied, or otherwise affixed using any other technique to the compression ring 205 and laminated on the top surface of the dome with a sealant/adhesive. In an example, the protective panel 352 may a 0.05 inch thick aluminum panel (or a panel made with any other material and/or having any other thickness).

In other examples, the fastener 502 may be affixed from an outer surface of the storage tank. For example, the fastener 502 may be driven/inserted into the batten 504 and the structural member 510 from over the dome (e.g., convex/outer surface of the dome and/or convex surface/side of the batten 504). For a flat cover, the fastener 502 may be driven/inserted into the batten 504 and the structural member 510 from an outer surface of the flat cover (e.g., outer surface of the batten 504).

In other examples, the radial edges of the panels 508 may not be bent. For example, the gaskets 506 may be substantially parallel to the panels 508, with the horizontal plate of the structural member 510 not including the slot 516. The batten 504 may be affixed over the panels 508 and the horizontal plate of the structural member 510. In one such example, the panels 508 may at least partially overlap, with the fastener 508 being inserted into the structural member 510, the overlapping panels 508, and the batten 504.

The use of radial subsections/panels and battens as described herein may provide multiple advantages. A radial subsection of the dome may extend as a single piece, from a center of the dome to an upper edge or surface associated with the tank shell, without requiring any horizontal battens and hub covers (e.g., as necessary in geodesic domes). Absence of horizontal battens and hub covers in the radial subsections may enable an unimpeded flow of water off the dome and prevent pooling. Reduced pooling may reduce probability of water leaking into the dome. The curved shape of the radial subsection may add strength to the structure in addition to an aesthetic appeal.

The battens may have a design that is flush (or substantially flush) to the surface of the dome and/or otherwise may have a low profile. The battens may also be continuous, extending outwards from the center of the dome. Accordingly, no discontinuities in the form of hub covers (e.g., as present in geodesic domes) may be present in the example dome described herein. The use of flush, continuous battens may remove any structural features that may impede the flow of water off the surface of the dome.

Even if water is able to enter through a border between the radial subsections/panels and the batten, a slot included in the structural members may enable drainage of water. For example, the slot may effectively function as a drain channeling water radially outward away from the center of the dome. The water channeled outward may be allowed to drip out. In this manner, the structural member may provide an additional layer of protection against potential water leakage.

The dome may not have any exposed fasteners on the top surface of the dome. Lack of exposed fasteners may avoid issues such as water leakage into the dome via gaps between fasteners and the dome surface (e.g., as observed in domes with exposed fasteners).

The design/assembly of the dome using radial subsections/panels, battens, structural members, and fasteners as described herein may provide for a much smaller watershed for water to collect on the dome in comparison with other dome designs. For example, only water that directly lands on a gasket may have access to a gasketed joint between the battens and the radial subsections/panels. Even if water accesses/enters the gasketed joint, the slot of the structural member may effectively drain water away from the dome.

Further, the dome may require fewer quantity of parts, and/or less overall time for assembly, than required in similarly sized geodesic domes. Additionally, the dome may use fewer unique parts than used in similarly sized geodesic domes. These aspects of the proposed design may reduce fabrication complexity and system costs.

Figure 6:
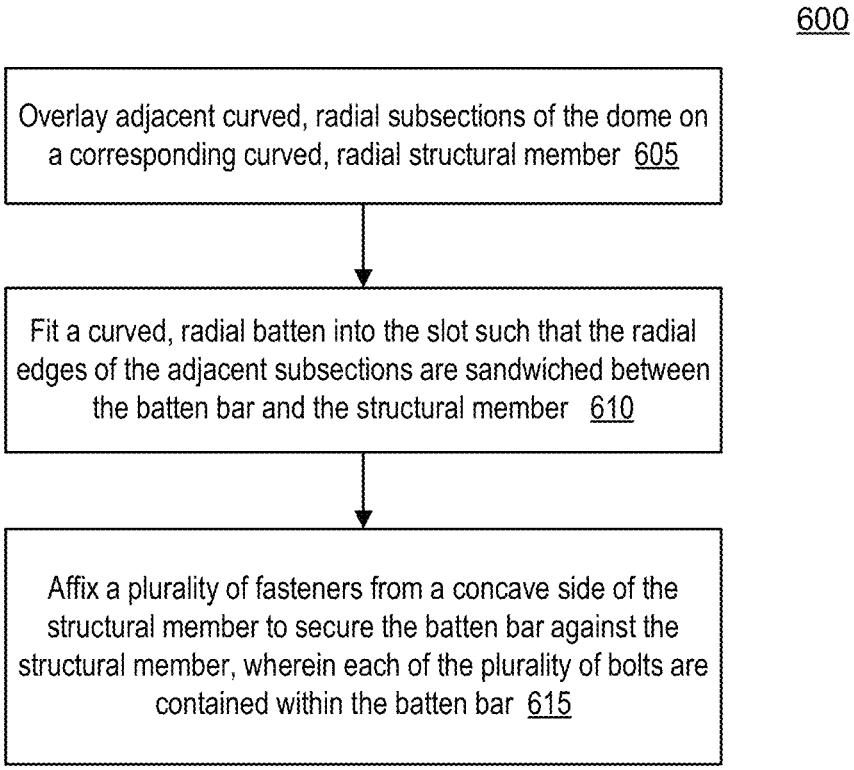
FIG. 6 shows an example method for assembling a dome for covering a storage tank.

FIG. 6 shows an example method for assembling a dome for covering a storage tank. The dome may comprise a plurality of curved, radial panels/subsections that are attached using battens and structural members (e.g., as described herein with respect to FIGS. 2A-2D and 3A). More specifically, the example method 600 of FIG. 6 may be used to create a joint assembly to attach two adjacent curved, radial panels of the dome. The joint assembly may advantageously not include any protrusions on a top surface of the dome.

At step 605, adjacent curved, radial panels of the dome may be overlaid on a corresponding curved, radial structural member. The radial edges of the adjacent panels may be curved inwards and fitted into a slot (e.g., a radial slot) of the structural member. The curve of the radial edges may be in the form of a spline.

At step 610, a curved, radial batten may be fit into (e.g., slid into) the slot. Fitting the batten into the slot may result in the radial edges of the adjacent panels to be wedged between the batten and the structural member.

At step 615, a plurality of fasteners (e.g., screws, bolts) may be affixed to the structural member. For example, the fasteners may be affixed from a concave side (e.g., concave surface of a horizontal plate) of the structural member. The fasteners may be affixed to secure the batten against the structural member. Each of the plurality of bolts may be contained within the batten bar. Each of the plurality of fasteners may be sized such that the fasteners are contained within the batten (e.g., do not extend out of the top surface of the dome).

A cover for a tank shell of a storage tank may comprise one or more components. The cover may comprise a plurality of radial panels. Each panel may be affixed to a compression ring at a first end (e.g., first edge) and may be configured to be affixed to an upper edge of the tank shell at a second end (e.g., a second edge). The cover may further comprise a plurality of radial structural members. Radial edges of adjacent panels of the cover may be bent inwards and fitted into a corresponding slot of a corresponding structural member. The cover may further comprise a plurality of radial battens. A corresponding batten may be fit into the corresponding slot such that the radial edges of the adjacent panels are located between the corresponding batten and the corresponding structural member. The cover may further comprise a plurality of fasteners. The plurality of fasteners may be affixed from inner surfaces of the structural members (e.g., inner surface of the cover) to secure the battens against the structural members. Alternatively, the plurality of fasteners may be affixed from outer surfaces of the battens (e.g., outer surface of the cover) to secure the battens against the structural members. Each of the plurality of fasteners may be sized to be contained within the battens. The cover may further comprise gaskets in interfaces between the battens and the panels. The radial edges of the adjacent panels may be formed along a spline. The panels may be welded, epoxied, bolted, or otherwise affixed using any other technique to the compression ring at a center of the cover. The panels may be affixed to supports on an upper edge of the tank shell. One or more of the plurality of panels, the plurality of structural members, and the plurality of battens may be manufactured from aluminum. At least a portion of an upper surface of the cover may comprise a protective panel. The plurality of battens may comprise screw chases for the plurality of fasteners. Each of the plurality of fasteners may be sized to not extend out of exposed surfaces of the battens. The cover may be a dome-shaped cover. The plurality of panels, the plurality of structural members, and the plurality of battens may be curved. The plurality of fasteners being affixed from inner surfaces of the structural members may comprise the plurality of fasteners being affixed from concave surfaces of the structural members.

A joint assembly may be used to attach two panels. The joint assembly may comprise a structural member comprising a slot. At least one edge of each of the panels may be bent inward and fitted into the slot. The joint assembly may further comprise a batten that is fit into the slot such that the bent edges of the panels are located between the batten and the structural member. The joint assembly may further comprise a plurality of fasteners. The plurality of fasteners may be affixed through the structural member to secure the batten against the structural member. Each fastener of the plurality of fasteners may be sized to be contained within the batten. The two panels may correspond to curved, radial panels of a dome. The two panels may correspond to flat, radial panels of a flat, circular cover. The joint assembly may comprise gaskets in interfaces between the batten and the panels. At least one edge of each of the panels may be formed along a spline. One or more of the two panels, the structural member, and the batten may be manufactured from aluminum. The batten may comprise screw chases for the plurality of fasteners. Each of the plurality of fasteners may be sized to not extend out of an exposed surface of the batten.

A method for assembling a cover for a tank shell of a storage tank may comprise multiple steps. The method may comprise overlaying adjacent radial panels of the cover on a corresponding radial structural member. Radial edges of the adjacent panels may be bent inwards and fitted into a slot of the structural member. The method may further comprise fitting a radial batten into the slot such that the radial edges of the adjacent panels are located between the batten and the structural member. The method may further comprise affixing a plurality of fasteners from an inner surface of the structural member to secure the batten against the structural member. Each of the plurality of fasteners may be sized to be contained within the batten. The method may further comprise attaching gaskets in interfaces between the battens and the panels. The radial edges of the adjacent panels may be formed along a spline. The method may further comprise welding respective first edges of the radial panels to a compression ring at a center of the dome. The method may further comprise attaching respective second edges of the radial panels to supports on an upper edge of the tank shell. The cover may be a dome-shaped cover. The panels, the structural member, and/or the batten may be curved. The plurality of fasteners being affixed from an inner surface of the structural member comprises the plurality of fasteners being affixed from a concave surface of the structural member.

Aspects of the disclosure have been described in terms of illustrative embodiments thereof. Numerous other embodiments, modifications, and variations within the scope and spirit of the appended claims will occur to persons of ordinary skill in the art from a review of this disclosure. For example, one or more of the steps depicted in the illustrative figures may be performed in other than the recited order, and one or more depicted steps may be optional in accordance with aspects of the disclosure.

The invention claimed is:

1. A cover for a tank shell of a storage tank, the cover comprising:

a plurality of radial panels, wherein each panel is configured to be affixed to a compression ring at a first end and is configured to be affixed to an upper edge of the tank shell at a second end;

a plurality of radial structural members, wherein radial edges of adjacent panels, of the plurality of radial panels, each have a bend that configures each of the radial edges of the adjacent panels to fit into a single corresponding slot of a corresponding structural member, and wherein the corresponding structural member comprises a corresponding pair of vertical plates extending radially and perpendicular to an inner surface of the corresponding structural member;

a plurality of radial battens, wherein a corresponding batten is configured to fit into the corresponding slot such that the radial edges of the adjacent panels are located between the corresponding batten and the corresponding structural member, and wherein the battens comprise a plurality of screw chases; and a plurality of fasteners, wherein:

the fasteners are configured to be inserted, into the structural members and the screw chases, from inner surfaces of the structural members to secure the battens against the structural members, corresponding fasteners are configured to be inserted, into the corresponding structural member and corresponding screw chases, from between the corresponding pair of vertical plates of the corresponding structural member, and the fasteners and the screw chases are sized such that the fasteners are contained within the battens.

2. The cover of claim 1, further comprising gaskets in interfaces between the battens and the panels.

3. The cover of claim 1, wherein the radial edges of the adjacent panels are formed along a spline.

4. The cover of claim 1, wherein the panels being configured to be affixed to the compression ring comprise the panels being welded to the compression ring.

5. The cover of claim 1, wherein the panels being configured to be affixed to the upper edge of the tank shell comprises the panels being configured to be affixed to supports on the upper edge of the tank shell.

6. The cover of claim 1, wherein one or more of the panels, the structural members, and the battens are manufactured from aluminum.

7. The cover of claim 1, wherein at least a portion of an upper surface of the cover comprises a protective panel.

8. The cover of claim 1, wherein:

the cover is a dome-shaped cover, the panels, the structural members, and the battens are curved, and the fasteners being configured to be inserted from the inner surfaces of the structural members comprises the fasteners being configured to be affixed from concave surfaces of the structural members.

9. The cover of claim 1, wherein each of the plurality of fasteners is sized to not extend out of exposed surfaces of the battens.

10. A joint assembly comprising:

two panels;

a structural member comprising a single slot, wherein corresponding edges of the panels each have a bend that configures each of the edges of the panels to fit into the slot, and wherein the structural member comprises a pair of vertical plates extending perpendicular to an inner surface of the structural member;

a batten that is configured to fit into the slot such that the edges of the panels are located between the batten and the structural member, wherein the batten comprises a plurality of screw chases; and a plurality of fasteners, wherein:

the fasteners are configured to be inserted, into the structural member and the screw chases, from the inner surface of the structural member to secure the batten against the structural member, the fasteners are configured to be inserted, into the structural member and the screw chases, from between the pair of vertical plates of the structural member, and the fasteners and the screw chases are sized such that the fasteners are contained within the batten.

11. The joint assembly of claim 10, wherein the two panels correspond to:

curved, radial panels of a dome, or flat, radial panels of a flat, circular cover.

12. The joint assembly of claim 10, further comprising gaskets in interfaces between the batten and the panels.

13. The joint assembly of claim 10, wherein the at least one-edges of each of the panels are formed along a spline.

14. The joint assembly of claim 10, wherein one or more of the two panels, the structural member, and the batten are manufactured from aluminum.

15. A method for assembling a cover for a tank shell of a storage tank, the method comprising:

overlaying adjacent radial panels of the cover on a corresponding radial structural member, wherein the structural member comprises a pair of vertical plates extending perpendicular to an inner surface of the structural member;

bending radial edges of the adjacent panels;

fitting the radial edges of the adjacent panels into a single corresponding slot of the corresponding structural member;

fitting a radial batten into the slot such that the radial edges of the adjacent panels are located between the batten and the structural member, wherein the batten comprises a plurality of screw chases; and inserting a plurality of fasteners, into the structural member and the screw chases, from an inner surface of the structural member to secure the batten against the structural member, wherein:

inserting the fasteners into the structural member and the screw chases comprises inserting the fasteners from between the pair of vertical plates of the structural member, and the fasteners and the screw chases are sized such that the fasteners are contained within the batten.

16. The method of claim 15, wherein:

the cover is a dome-shaped cover, the panels, the structural member, and the batten are curved, and inserting the fasteners from an inner surface of the structural member comprises inserting the fasteners from a concave surface of the structural member.

17. The method of claim 15, wherein the radial edges of the adjacent panels are formed along a spline.

18. The method of claim 15, further comprising:

welding respective first edges of the panels to a compression ring at a center of the cover; and attaching respective second edges of the panels to supports on an upper edge of the tank shell.

19. The method of claim 15, wherein one or more of the panels, the structural member, and the batten are manufactured from aluminum.

20. The cover of claim 1, wherein the vertical plates are configured to be welded to the structural member.

* * * * *